US006397130B1

(12) United States Patent
Carr et al.

(10) Patent No.: US 6,397,130 B1
(45) Date of Patent: May 28, 2002

(54) MULTI-SENSOR ROUTE DETECTOR FOR RAIL VEHICLE NAVIGATION

(75) Inventors: Gary A. Carr, Fairfax; Brian E. Mee, Manassas, both of VA (US); J. Kevin Kesler, Silver Spring, MD (US); Boris Nejikovsky, Vienna, VA (US)

(73) Assignee: ENSCO, Ltd., Springfield, VA (US)

( * ) Notice: Subject to any disclaimer, the term of this patent is extended or adjusted under 35 U.S.C. 154(b) by 0 days.

(21) Appl. No.: 09/833,075

(22) Filed: Apr. 12, 2001

Related U.S. Application Data

(60) Provisional application No. 60/196,938, filed on Apr. 13, 2000.

(51) Int. Cl.[7] ..... G01D 5/26; E01C 23/00

(52) U.S. Cl. ..... 701/19; 250/559.29; 250/559.38; 33/287; 33/338; 73/146; 73/104; 73/174

(58) Field of Search ..... 701/19, 20, 205; 105/3, 168; 342/357, 457, 597; 73/597, 146, 105, 174; 343/357; 356/1; 33/366, 651, 287, 338; 340/500, 933; 250/559.29, 559.38

(56) References Cited

U.S. PATENT DOCUMENTS 3,517,307 A 6/1970 Wallen, Jr. et al.
4,417,466 A 11/1983 Panetti
5,113,767 A 5/1992 Theurer
5,579,013 A * 11/1996 Hershey et al. ..... 342/357
5,791,063 A 8/1998 Kesler et al.
6,044,698 A * 4/2000 Bryan ..... 73/146
6,161,064 A * 12/2000 Strasser et al. ..... 701/19

* cited by examiner

*Primary Examiner*—Michael J. Zanelli
*Assistant Examiner*—Tuan C To
(74) *Attorney, Agent, or Firm*—Nixon Peabody LLP; Jeffrey L. Costellia

(57) ABSTRACT

The multi-sensor route detector system preferably consists of at least four sensors (three rail detectors and a truck angle detector), sensor power supplies, signal conditioning for the output of the sensors, and a computer performing pattern matching and logic functions to positively identify track features of interest. The system is not a stand-alone navigation system, but will interface with the rest of the vehicle navigation system and provide data over an interface. This data will include notification of passage of turnouts, whether or not the route changed through the turnout and possibly the type of turnout (i.e., number 6 left). From external sensors, the multi-sensor route detector will obtain a signal such as block distance pulse indicating distance traveled along the track. The best estimate of the vehicle position will also be sent to the multi-sensor route detector. Based on the present position, the multi-sensor route detector will access the appropriate turnout data from its internal database.

16 Claims, 6 Drawing Sheets

MULTI-SENSOR ROUTE DETECTOR FOR RAIL VEHICLE NAVIGATION

This application claims priority of a provisional patent application, U.S. Ser. No. 60/196,938, filed Apr. 13, 2000.

BACKGROUND OF THE INVENTION

In the past, a number of systems have been developed in an attempt to determine the position of a railway vehicle moving along a track. Early detection systems involved the use of track mounted switches or transducers which were activated by a passing railway vehicle to provide a position signal to a central station. Railway vehicle navigation systems became more sophisticated with the advent of the computer and satellite global positioning systems (GPS). Now a rapid response navigation system could be mounted on the railway vehicle to provide sequential position data as the vehicle moved along a route. The inputs to such navigation systems could involve speed and distance data from a wheel tachometer, a GPS position indicator, and sometimes sensed track anomalies occurring along the route for comparison with anomalies for the same route previously stored in a navigation computer.

Even the more sophisticated railroad vehicle navigation systems experience difficulty in providing accurate, real time information relative to the movement of a rail vehicle through turnouts, crossovers and other trackwork involving a plurality of parallel and/or intersecting tracks. However, the need to detect in real time changes of track is critical to rail navigation, for only by accurately and reliably determining which track a railway vehicle is on can safety be assured.

SUMMARY OF THE INVENTION

It is a primary object of the present invention to provide a novel and improved method and apparatus for detecting in real time movement of a rail vehicle through turnouts, crossovers and other trackwork involving a plurality of parallel and/or intersecting tracks.

Another object of the present invention is to provide a novel and improved multi-sensor route detector for rail vehicle navigation which employs at least three track rail sensors with a center track rail sensor mounted on a railroad vehicle so as to be positioned between the tracks over which the vehicle moves and a left and right track rail sensor mounted on the railroad vehicle so as to be spaced outwardly on either side of the track.

Yet another object of the present invention is to provide a novel and improved multi-sensor route detector for rail vehicle navigation which employs a truck angle sensor to provide an output indicative of the movement of a railway vehicle truck relative to the longitudinal axis of the railway vehicle body or frame.

A further object of the present invention is to provide a novel and improved multi-sensor route detector for rail vehicle navigation which employs the combined outputs of right, left and central track sensors and a truck angle sensor to detect in real time movement of a railroad vehicle through turnouts, crossovers and trackwork involving a plurality of parallel and/or intersecting tracks.

A still further object of the present invention is to provide a novel and improved method for rail vehicle route detection which includes obtaining a detection output pattern from rail detection sensors mounted on a railroad vehicle as the vehicle moves through turnouts, crossovers and trackwork involving a plurality of parallel and/or intersecting tracks along a rail vehicle route and comparing these patterns with previously detected and stored patterns for turnouts, crossovers and a plurality of parallel or intersecting tracks along the same route.

These and other objects of the present invention are achieved by providing a multi-sensor route detector for rail vehicle navigation which includes at least three sensors for detecting the presence of metal rails. These sensors are mounted on a railway vehicle with one central sensor positioned between tracks over which the vehicle moves and two sensors positioned in spaced relation outboard on opposite sides of the track. These rail detecting sensors sense different rail crossing configurations as the railway vehicle moves into and through turnouts, crossovers and trackwork involving a plurality of parallel and/or intersecting tracks and provides output signature patterns unique to each. Signal processing and signal conditioning equipment receives and compares the output signature patterns from the rail detecting sensors with previously stored signature patterns of all possible turnout geometries along the route in the general area of interest and determines which route the railway vehicle took through the turnout.

DESCRIPTION OF THE PREFERRED EMBODIMENTS

The positive determination of the route taken by a railway vehicle through turnouts is the key to achieving positive train location and safety assurance. A turnout is a track structure designed to allow railway vehicles to either continue along their present route or to change to a different route or track. Single turnouts typically lead from a main track to a spur or siding, while a combination of two turnouts, called a crossover, allows a railway vehicle to change from one parallel track to another. The motion of a railway vehicle through any of these turnouts is very predictable and the geometry of the turnouts is standardized in the railroad industry. However, there are other cases of turnout design and crossings which are referred to as special trackwork.

Figure 1:
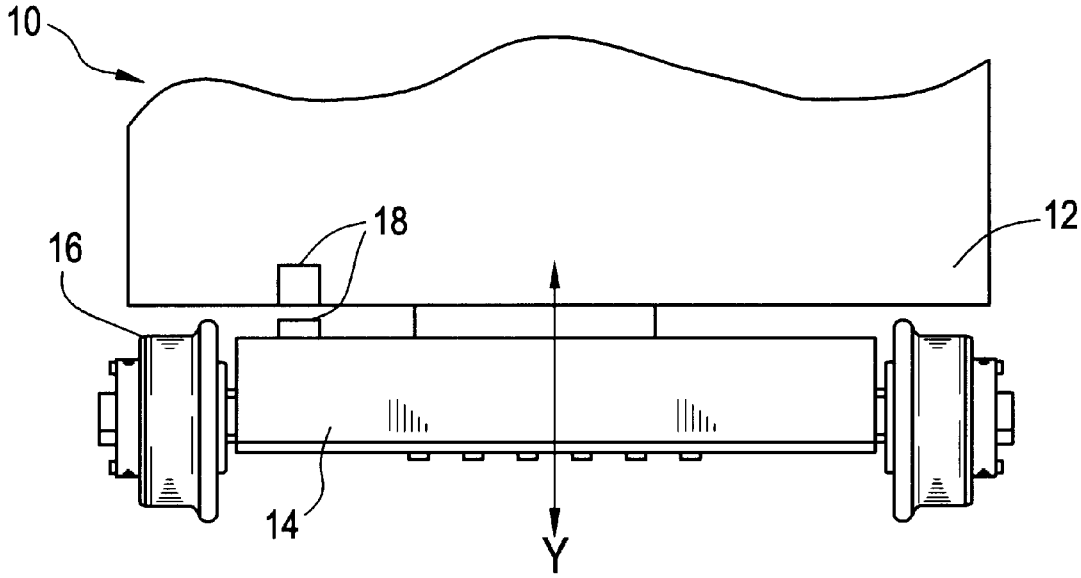
FIG. 1 is a view in front elevation of a railway vehicle truck and body bearing a truck angle sensor.

Conventionally, a railway vehicle 10 includes a body or frame 12 which is mounted upon rotatable trucks 14 bearing track engaging, flanged wheels 16. One such truck is illustrated in FIG. 1. The motion of the truck 14 in following the track through a turnout will result in rotation of the truck about an axis Y and angularly away from alignment with the longitudinal axis of the frame 12. In the case of the crossover, upon reaching the new parallel route, similar rotation of the truck in the opposite direction will result as the new track is reached.

Figure 2:
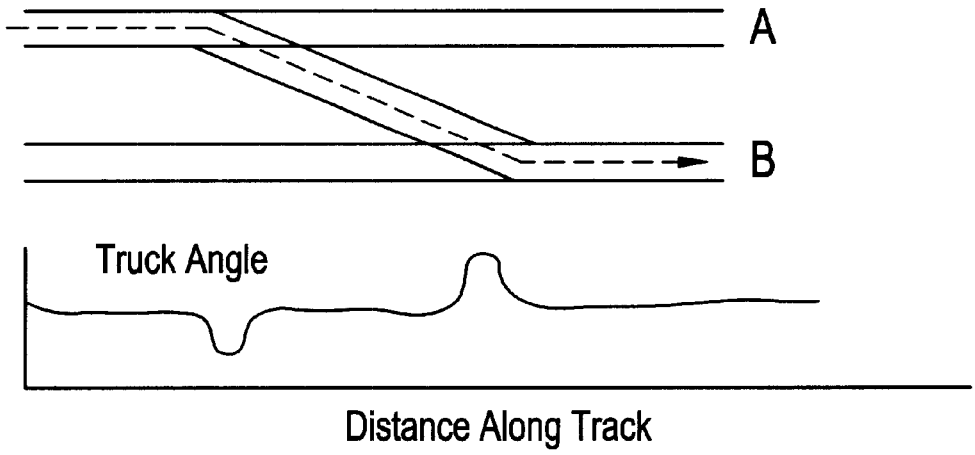
FIG. 2 is a diagram showing a truck angle sensor output pattern for movement of a railway vehicle from one track to a parallel track.

In accordance with the present invention the truck angle relative to the longitudinal axis of the body or frame 12 is measured by one or more truck angle sensors 18. This measurement of truck angle can be accomplished by a number of conventional off-the-shelf sensors. For example, the relative movement between the truck and body can be sensed by an array of Hall Effect sensors mounted upon either the body structure or the truck with a magnet being mounted on the opposite structure so as to cooperate with the Hall Effect sensors during rotation of the truck. Alternatively, a mechanical link could be established between the truck or body with a linear, variable differential transformer mounted on the opposite structure. Obviously, there are many known electrical, electro-optical and electromechanical sensors which will provide truck angle output signals as a railway vehicle moves through a crossover or turnout. The signature of the truck rotation angles during passage through a crossover or a turnout to a parallel track such as a passing siding will be distinct. FIG. 2 shows the expected truck angle signal pattern for such a move from track A to track B. The distance between the pulses is indicative of the distance traveled along the crossover.

The truck angle sensor function could also be accomplished or backed up by the signal from a yaw rate sensor such as a MEMs gyro or conventional rate gyro. However, the truck angle sensor has the advantage of working at very slow speeds as the rail vehicle moves slowly through a turnout.

If the system of the present invention will be "Armed" by a navigation system when it approaches a switch, and the signatures of each of the possible routes at that switch are known to the system in advance, then truck angle alone may be sufficient to detect turnout passage and identify the route taken. The truck rotation signature as a function of distance down the track will uniquely identify the route taken. A GPS unit or the output from a separate locomotive navigation system are possible means for arming the system of the present invention as a turnout is approached. Truck rotation angle alone, may sometimes not be sufficient to detect passing a turnout on the straight-through path, or to distinguish this from a tangent track.

In addition to a sensor or sensors for measuring truck rotation and distance through a crossover or turnout, at least three sensors 20, 22 and 24 for detecting the presence of metal rails are provided. These sensors may be mounted on a truck 14 or on the body 12 in the manner shown in FIG. 3 so that when the railway vehicle is positioned on a straight stretch of track 26, a left sensor 20 and a right sensor 24 are equally spaced outwardly on either side of the tracks while a central sensor 22 is centrally located between the tracks. The sensors 20, 22 and 24 may be inductive metal detectors with a well defined pattern based upon a design for an Automatic Location Device (ALD) which is a component of a track Geometry Measurement System developed by Ensco, Inc. of Springfield, Va.

Figure 3:
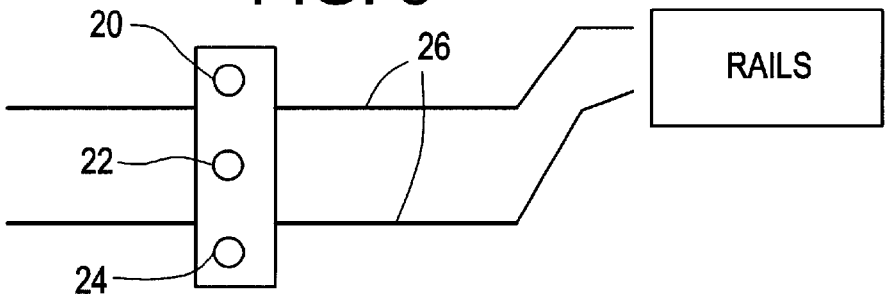
FIG. 3 is a diagram showing the positioning relative to the tracks of three track detection sensors mounted on a railway vehicle.

ALD sensors were developed to positively locate track features for correlation with track geometry data. One ALD sensor is located on the track centerline where it provides a voltage output proportional to the amount of metal sensed in the ALD pickup area. The ALD sensor consists of two coils oriented 90 degrees apart. A current is sent through one coil, and normally no voltage is induced in the second coil from this current. If metallic objects are present, they will alter the magnetic field from the first coil and cause voltage to be induced in the second coil. The output voltage of the second coil is then a measure of the closeness and amount of metal present in the sensing area. A single ALD sensor will provide a distinctive signal as it passes over a "crossing rail" in a turnout. Unfortunately, during movement through a turnout in either the straight through or the diverging route, no crossing rail is encountered. There a single central ALD sensor will not provide positive indication of the route taken. In order to overcome this problem, the two additional ALD sensors are added to the system. These sensors are mounted to sense metal outside the normal gage of the rails as shown in FIG. 3. This configuration permits the geometry of a turnout or crossover to be sensed to positively identify the route taken.

Figure 4:
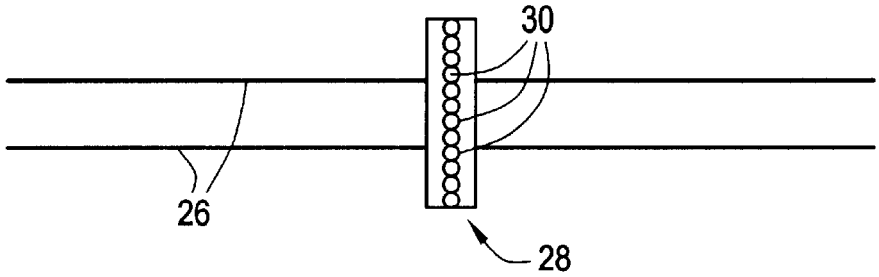
FIG. 4 is a diagram showing the positioning relative to the tracks of a multi-sensor track detection array mounted on a railway vehicle.

Additional ALD sensors or a different type of sensor that can detect the presence of railroad rails could be used to perform the same function. A sensor array would provide better reliability and availability than individual sensors if enough sensor elements were used to provide overlapping coverage in the areas where rails were expected to be located. The output of a multiple element rail detector sensor might provide a continuous "picture" of the track structure including guard rails on bridges and possibly road crossings and other track structure features. Signal processing of this "picture" could then be done to identify the presence of turnouts and the route taken through the turnouts. In addition to the function of route identification and confirmation, identification of passage over these track details may provide additional information to the overall vehicle navigation system. A conceptual multi-element rail sensor array 28 is shown in FIG. 4 where multiple, closely spaced sensors 30 span the tracks 26 and an equal number of closely spaced sensors extend outwardly on both the left and right sides of the track.

Figure 5:
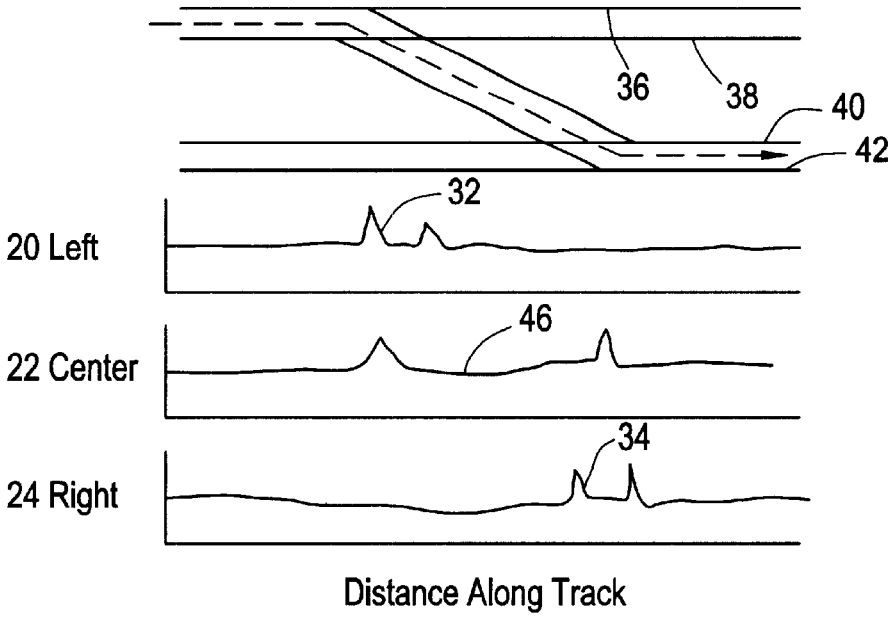
FIG. 5 is a diagram showing the output pattern for the track detection sensors of FIG. 3 when the railway vehicle moves over a crossover from one track to a parallel track.

For simplicity of explanation, the signal patterns provided by the three sensors 20, 22 and 24, will be described. These can be ALD sensors or other sensors which provide output peak signals upon detection of a rail. In FIG. 5, the expected response of the three sensors to a diverging route through a crossover is shown. The distinctive patterns 32 and 34 produced by the left and right sensors 20 and 24 respectively include double peaks as each sensor responds to two rails. The pattern 32 is caused as the left sensor 20 crosses rails 36 and 38, while the pattern 34 results from the right sensor 24 crossing the rails 40 and 42. The central sensor 22 provides a peak pattern 46 as it crosses the rails 38 and 40. The spatial relationship between the peaks of the outside patterns 32 and 34 with those of the center pattern 46 permit identification of the turnout traversed (left or right hand) as well as providing a positive indication of the change of track movement.

Figure 6:
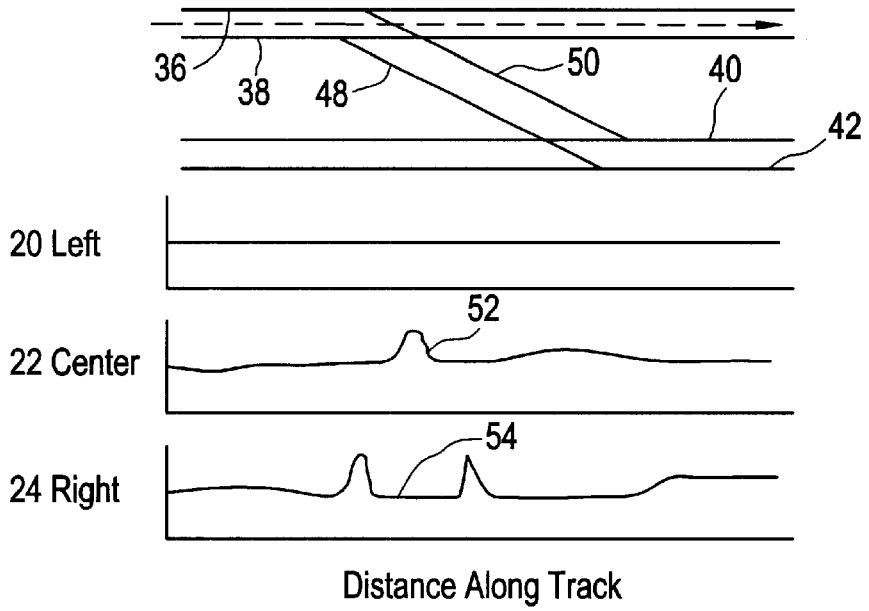
FIG. 6 is a diagram showing the output pattern for the track detection sensors of FIG. 3 when the railway vehicle remains on a main track and passes by a crossover.

FIG. 6 illustrates the patterns provided by the sensors 20, 22, and 24 when the railway vehicle remains on the tracks 36 and 38 and moves through the crossover shown in FIG. 5. Here there is no signal from the left sensor 20 indicating that no track was crossed by this sensor, and therefore the route of the railway vehicle did not change. However, the center sensor 22 crosses the rail 48 of the turnout to provide the single pulse pattern 52 while the right sensor 24 crosses both rails 48 and 52 of the turnout to provide the double pulse pattern 54. These pulse patterns plus the lack of a pulse pattern from the left sensor 20 are a clear indication that a turnout has been encountered.

Figure 7:
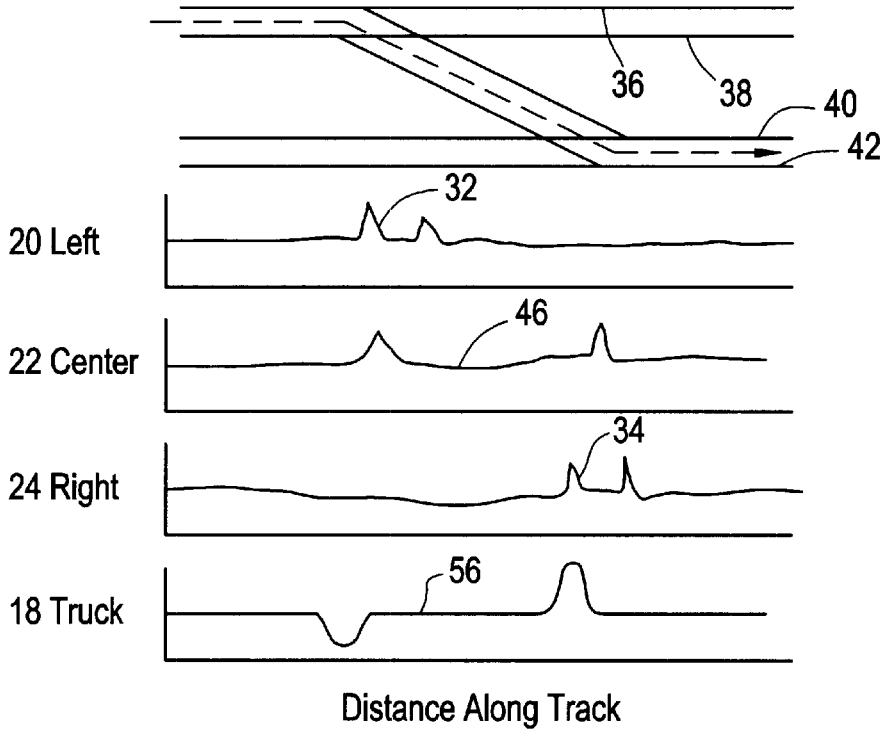
FIG. 7 is a diagram showing the output pattern for the truck angle sensor of FIG. 1 and the track detection sensors of FIG. 3 when the railway vehicle moves over a crossover from a main to a parallel track.

The use of the truck angle sensor 18 and the three track sensors 20, 22, and 24 in combination allows some redundancy in determining routes, which will increase the probability of correct detection of routing. FIG. 7 illustrates the pulse patterns which will be provided by this combination as the railway vehicle traverses the crossover of FIG. 5. Here, the dual pulse pattern 56 from the truck angle sensor 18 not only provides a positive indication of change of direction at each turnout, but also acts as a backup for the pulse pattern 46 of the center sensor 22 in locating the turnouts. Each time a turn is made, a pulse for the pulse pattern 56 is provided by the sensor 18, and distance between turns is indicated by the distance between pulses.

When the railway vehicle takes the straight through route past the crossover of FIG. 6, the pulse pattern provided by the combination of the sensors 18, 20, 22 and 24 will be identical to the pulse pattern shown in FIG. 6, for no turns have been made which would generate an additional pulse pattern from the truck angle sensor 18. The lack of a truck angle trace provides a positive indication that the railway vehicle did not change tracks.

Figure 8:
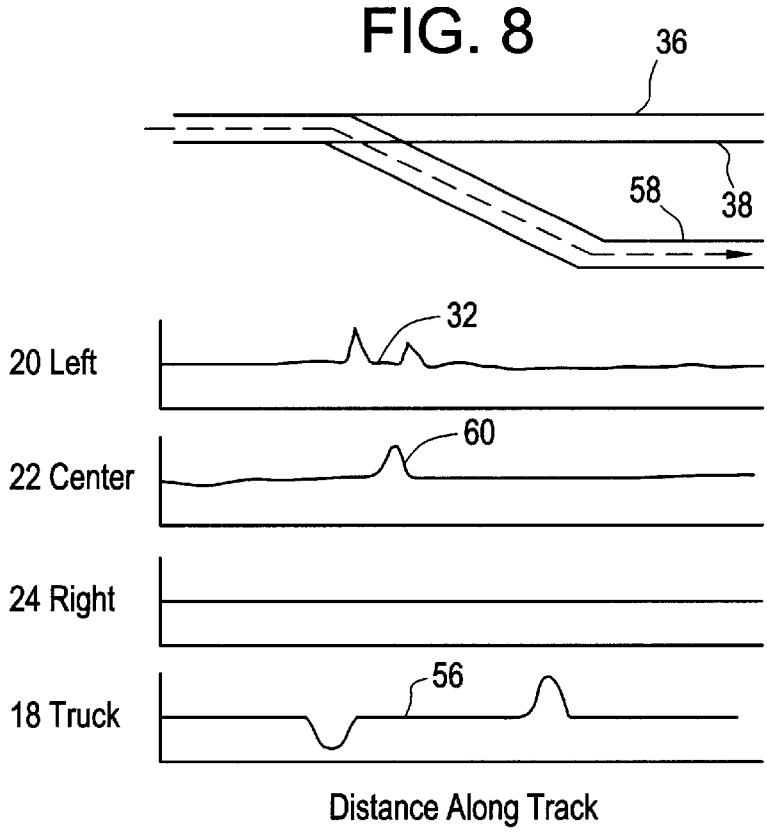
FIG. 8 is a diagram showing the output pattern for the truck angle sensor of FIG. 1 and the track detection sensors of FIG. 3 when the railway vehicle moves over a turnout from the main track.

A change of route by a railway vehicle to a parallel siding is very similar to the diverging route through a crossover of FIG. 7, but as illustrated by FIG. 8, the sensors 18, 20, 22 and 24 provide a pulse pattern distinct from that of FIG. 7. Since two turns occur and the left sensor 20 crosses the tracks 36 and 38, the pulse patterns 32 and 56 remain the same as those shown in FIG. 7. However, no output is received from the right sensor 24 indicating that the new siding track 58 is not part of a continuous parallel track. Also the center sensor 22 provides only a single pulse pattern 60 from the rail 38 which confirms that only one turnout was traversed.

Figure 9:
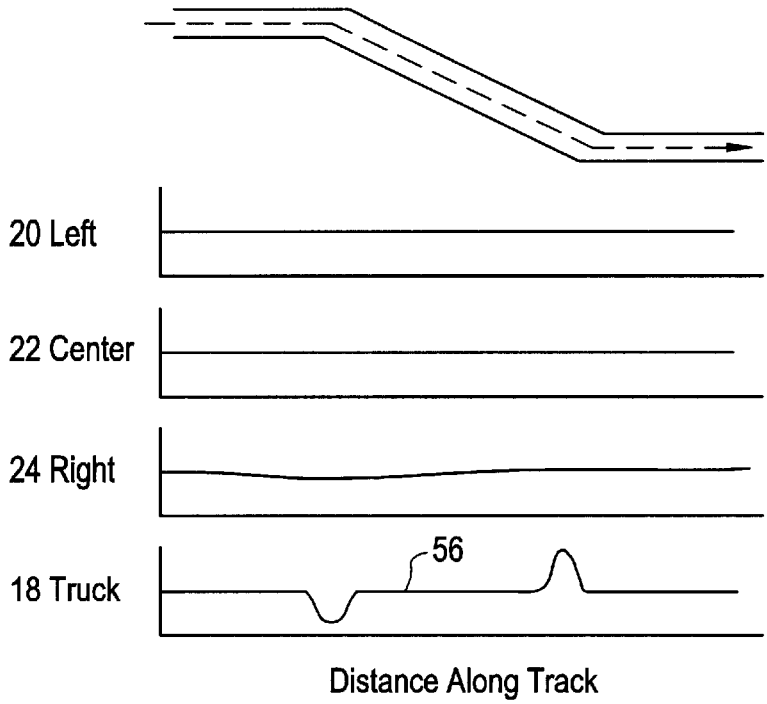
FIG. 9 is a diagram showing the output pattern for the truck angle sensor of FIG. 1 and the track detection sensors of FIG. 3 when the railway vehicle moves through reverse curves on a main track.

A track pattern similar to either the crossover of FIG. 7 or the parallel siding turnout of FIG. 8 can be created by closely spaced reverse curves. This situation may occur if turnouts are removed to eliminate a former siding or if the former main line is closed and the former siding becomes the mainline as shown in FIG. 9. In this case, the lack of turnouts is indicated by the lack of pulses from the sensors 20, 22 and 24, but the truck angle sensor 18 still provides the pulse pattern 56 to show the change in lateral position indicated by the truck rotation angle changes. It is noteworthy that without the addition of the truck angle sensor 18 to the sensors 20, 22 and 24, there would be no response to this reverse curve track pattern.

Figure 10:
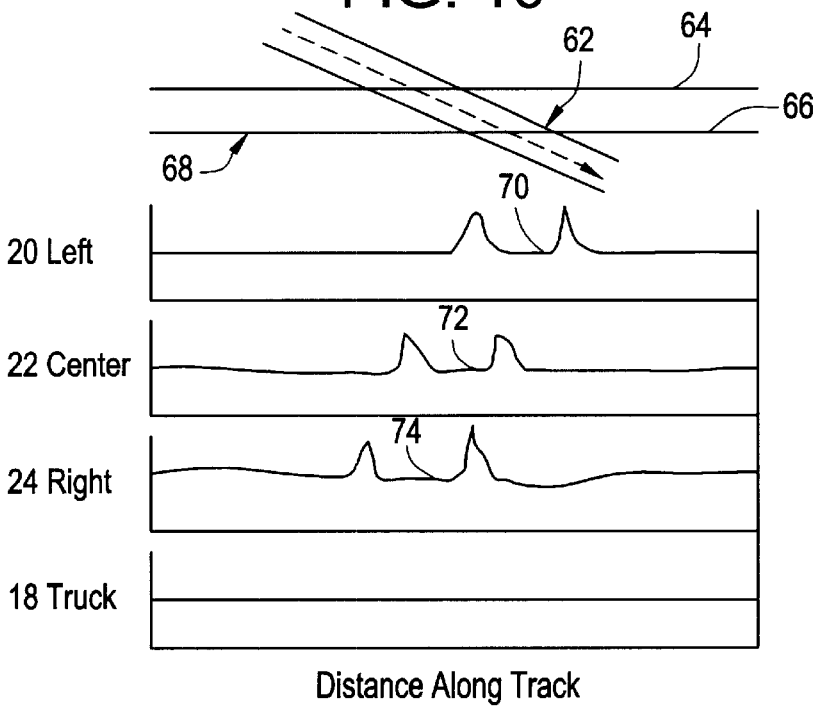
FIG. 10 is a diagram showing the output pattern for the truck angle sensor of FIG. 1 and the track detection sensors of FIG. 3 when the railway vehicle follows a crossing diamond path across a second track.

One of the key capabilities of the multi-sensor system of the present invention is the ability to distinguish special trackwork from the turnouts previously discussed. For example, a crossing diamond is used any time tracks cross each other without need for moving trains from one track to the other such as where two railroads must cross. FIG. 10 shows the response of the sensors to this situation. In FIG. 10, the railway vehicle remains on the track 62 as it crosses the rails 64 and 66 of a second track 68. The sensor pulse pattern resulting from a crossing diamond is unique, as the sensors 20, 22 and 24 each produce a closely spaced double pulse pattern 70, 72 and 74 respectively as each sensor crosses the rails 64 and 66. No turnout route produces closely spaced double pulse detections from all three sensors 20, 22 and 24, and the lack of a truck rotation pulse pattern from the sensor 18 confirms that no deviation from the track 62 was made.

Figure 11:
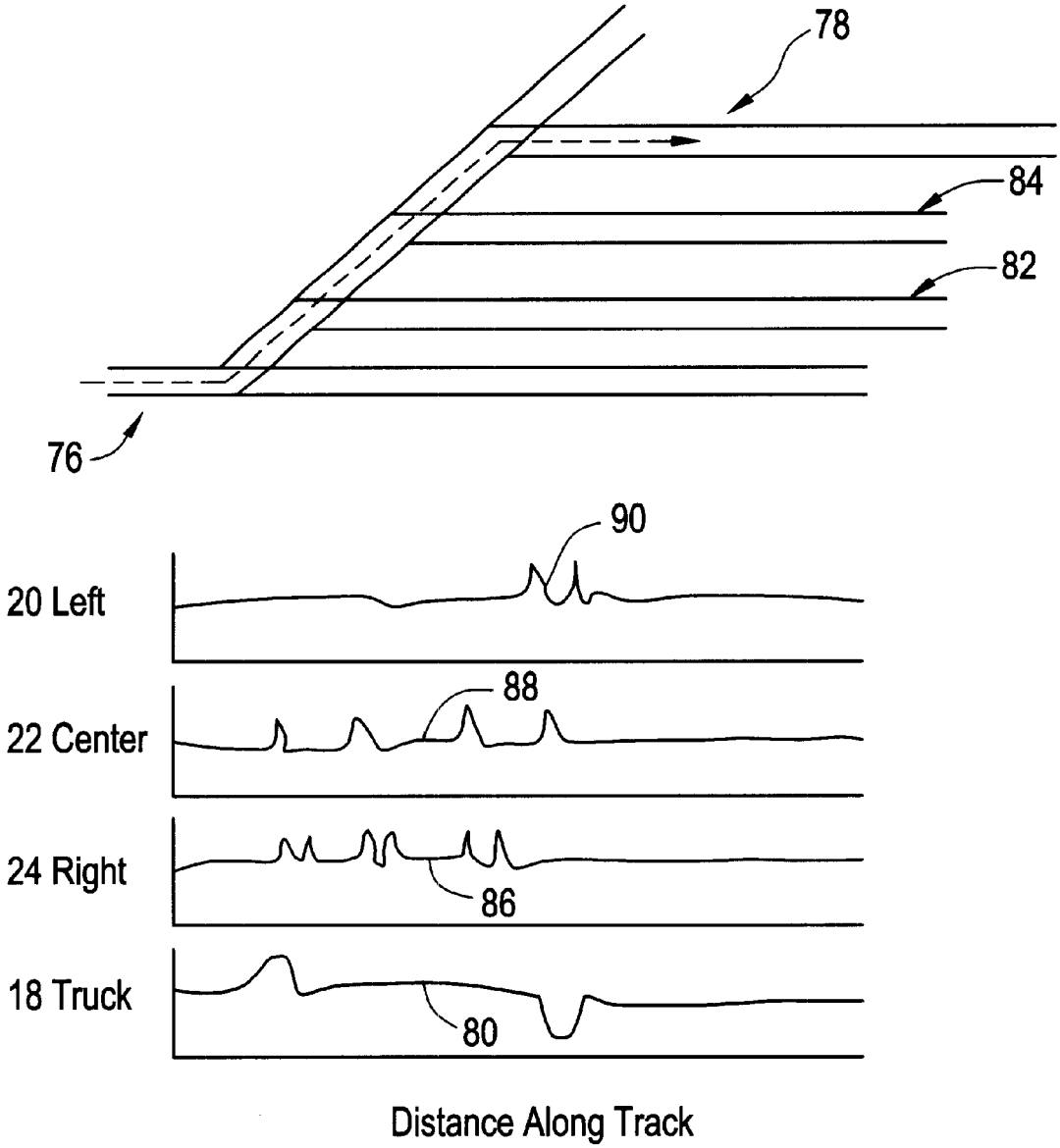
FIG. 11 is a diagram showing the output pattern for the truck angle sensor of FIG. 1 and the track detection sensors of FIG. 3 when the railway vehicle moves from a main track onto a third yard track.

One of the most challenging location events is the movement of a railroad vehicle in a yard environment. One feature of yards is what is known as a ladder track. In this configuration turnouts are spaced to allow access to multiple parallel tracks that make up the yard. Speeds in yards are typically less than 10 MPH which makes inertial-based location determination difficult. FIG. 11 shows the response of the multi-sensor system to movement of a railroad vehicle from a main track onto the third yard track. As the railway vehicle turns from the main track 76 and then onto the third yard track 78, the truck angle sensor 18 provides a two pulse pattern 80 which is a positive indication of a route change to the initial diverging route and from that route to the parallel track 78. The right sensor 24 provides a count of the number of tracks passed including the main track 76 and parallel tracks 82 and 84. This sensor provides a double peak pattern 86 as the sensor traverses the dual rails of the tracks 76, 82 and 84. Similarly, the sensor 22 provides a four peak pattern 88 with each peak indicating a turnout into the four tracks 76, 82, 84 and 78. The sensor 20 provides only a two peak pattern 90 as this sensor crosses two rails during the turn into the track 78. This pattern corresponds to the last peak in the pattern 80 from the truck angle sensor.

Figure 12:
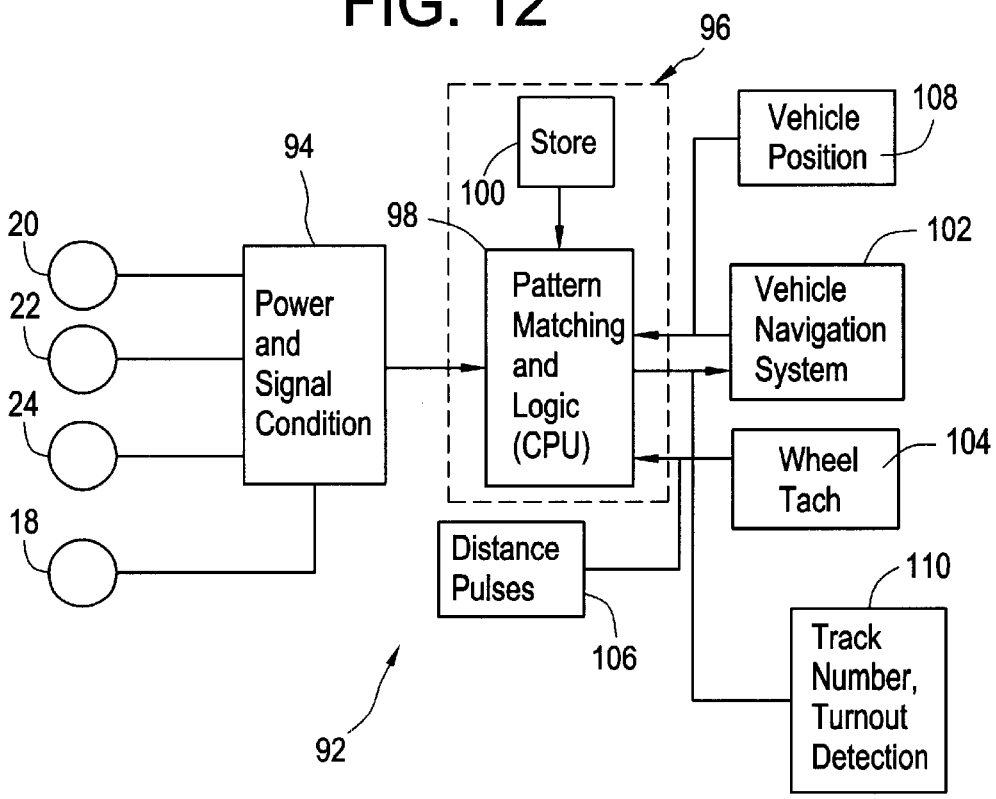
FIG. 12 is a block diagram of the multi-sensor route detector for rail vehicle navigation of the present invention.

The multi-sensor route detector for rail vehicle navigation of the present invention, indicated generally at 92 in FIG. 12 includes at least the four sensor systems 20, 22, 24 and 18 previously described with the sensor power supplies and signal conditioning for the sensor outputs shown at 94. From here, the sensor output patterns are provided to a central processor unit 96 which performs pattern matching at 98 with signature patterns stored in its internal database 100.

The multi-sensor route detector for rail vehicle navigation interfaces with a vehicle navigation system 102 and provides data over the interface. This data will include notification of the passage of turnouts, whether or not the route changed through the turnout, and possibly the type of turnout. From external sensors such as a wheel tachometer 104 and other distance sensors 106, the central processor unit 96 will receive a signal such as a block distance pulse indicating this distance traveled by a railway vehicle along a route. The multi-sensor route detector relies on distance-based data acquisition. This is a key to overcoming some of the shortcomings of inertial systems operating through turnouts at slow speeds. Many times turnouts are traversed at very slow speeds as trains are starting to move out of passing sidings etc. Therefore, a wheel tachometer 104 or encoder 106 is a basic part of the system. Vehicle position information may also be provided by a global positioning unit or other position locating unit 108. Based upon this position information, the central processor unit will access previously stored turnout data and often track numbers 110 from its internal database.

Using the vehicle mounted sensors of FIGS. 1 and 3, turnout data for a complete route is stored in the database for the central processor unit 96 to be subsequently accessed by a railway vehicle traveling over the route. The multi-sensor route detector 92 will detect the passage of switches along the route taken upon analysis of sensor data signatures in the distance domain. This information, combined with information from a switch database will allow the multi-sensor route detector to produce an absolute position update. Switch detection will also be used internally in the multi-sensor route detector to confirm progress within a specific switch tree.

The route database discussed above can be stored in a number of locations while supporting the function of the multi-sensor route detector. It could be a complete database of the entire railroad stored on the wayside and segments transmitted to the locomotive prior to a trip, or segments could be transmitted to the locomotive periodically during a journey while passing control points or other key locations.

The multi-sensor route detector will analyze the passage of switches, and the route taken through those switches to determine which route the vehicle is on. This information combined with data existing prior to entering the switch zone will determine which track the vehicle is on. At each individual switch the route detection options are straight-through or diverging. The combination of a series of route detections in a switch zone results in the current track or route position of the vehicle.

The key to efficient switch and route detection is the use of a switch database. This database will contain information on all of the switches on a railroad and the possible routes (track numbers) associated with them. Since the possible paths of the vehicle depend on the route taken through each switch, the topology of the information is in the form of a tree. Closely located switches such as at an interlocking or control point will be considered as one switch zone. The combination of information from multiple switches in a switch zone will be loaded into the route detection function when the multi-sensor route detector senses that the current position of the vehicle is at a specific distance from the edge of the switch zone.

Illustrative stored switch zone data is as follows:

SWITCH ZONE DATA

| | |
|---|---|
| X, Y, Z trigger point | 222, 333, 45 |
| Switch Zone Name | CP NEAR |
| No. of switches in zone | 1 |
| Type of switch | #10 Left hand (up milepost) |
| Routes | 4 |
| Route 1 (up milepost) | Track 1 - Track 1 Facing point, Straight move |
| Route 2 (up milepost) | Track 2 - Track 2 Facing point, Diverging move |
| Route 3 (down milepost) | Track 1 - Track 1 Trailing point, Straight move |
| Route 4 (down milepost) | Track 2 - Track 1 Trailing point, diverging move |
| Next switch zone (up milepost) | FAR |
| Next switch zone (down milepost) | Power Plant |
| X, Y, Z end point | 223, 334, 45 |

Linking the information in all of the switch zones creates a tree of possible tracks that the vehicle can traverse. Using the example at CP NEAR we see that if the vehicle is entering the zone in the up milepost direction the incoming track is track 1. At the switch if the move is a straight through move the track number will remain track 1 and will also remain track 1 for the next switch zone since it is a trailing point move for that switch in the up mile post direction. If however, the diverging route is taken at CP NEAR, the track will change to track 2.

The central processor unit can be connected to a display device to display the track number which the multi-sensor route detector has calculated.

The multi-sensor route detector will need to communicate with other onboard systems to receive and to transmit information. The design of this function will depend on the other systems onboard. It is reasonable to assume that some form of network or LAN will be used to communicate with other on-board computer equipment. The communications handler will provide the necessary protocols to format messages for this system and to decode messages addressed to the multi-sensor route detector. The basic message produced by the multi-sensor route detector is the track number that the vehicle is currently on. When switches are detected, an absolute position update message could be sent to the rest of the vehicle navigation system to correct errors such as inertial drift etc.

The multi-sensor route detector provides detection of track changes and confirmation of straight through moves at turnouts, crossovers, and other trackwork. This device can become an important part of an overall rail vehicle navigation system. Inputs to the multi-sensor route detector are distance traveled, and possibly notification of impending turnout passage from a track database. The outputs of the multi-sensor route detector are:

Positive indication of turnout detection

Indication of straight or diverging movement through the turnout if a turnout is passed Classification of the of the turnout by number and direction.

This classification can be compared to the track database as further confirmation of the vehicle location. The operation of the multi-sensor route detector can be enhanced by activating it only on approach to a known turnout of special trackwork feature and providing notification of the expected turnout geometry.

Since positive determination of the route taken through turnouts is the key to achieving positive train location and safety assurance, the multi-sensor route detector should become a key subsystem in many train control applications. The railroad industry seems to be heading toward a networked set of systems on locomotives and the multi-sensor route detector could easily be included in such a network to ease the functions of display and data collection.

We claim:

1. A multi-sensor route detector for a railway vehicle traveling a route along a track having two spaced rails comprising:

at least first, second and third rail sensors, each providing a rail sensing output signal upon crossing a rail, said first rail sensor being mounted on the railway vehicle in a position between the tracks supporting the railway vehicle, said second rail sensor being mounted on the rail vehicle in a position spaced outwardly from a first of said two spaced rails, and said third rail sensor being mounted on the rail vehicle in a position spaced outwardly from a second of said two spaced rails.

2. The multi-sensor route detector of claim 1 wherein said railway vehicle includes a vehicle body and a wheel supporting truck pivotally mounted on said vehicle body, and a truck angle sensor mounted on said railway vehicle to provide a truck angle signal when said wheel supporting truck pivots relative to said vehicle body.

3. The multi-sensor route detector of claim 1 which includes a central processing unit connected to receive the outputs from said rail sensors, said central processing unit including previously stored rail sensor outputs as stored signatures for special trackwork configurations along the route of said railroad vehicle, said central processing unit operating to compare the outputs from said rail sensors to one or more of said stored signatures.

4. The multi-sensor route detector of claim 3 which includes one or more vehicle position indicating units connected to said central processing unit to provide position data identifying the position of said railway vehicle to said central processing unit, said central processing unit operating in response to said position data to select stored signatures in an area of the position identified by said position data for comparison with the outputs from said rail sensors.

5. The multi-sensor route detector of claim 2 which includes a central processing unit connected to receive the outputs from said rail sensors and said truck angle sensor, said central processing unit including previously stored rail and truck angle sensor outputs as stored signatures for turnouts, crossovers and ladder track configurations along the route of said railroad vehicle, said central processing unit operating to compare the outputs from said rail and truck angle sensors to one or more of said stored signatures.

6. The multi-sensor route detector of claim 5 which includes one or more vehicle position indicating units connected to said central processing unit to provide position data identifying the position of said railway vehicle to said central processing unit, said central processing unit operating in response to said position data to select stored signatures in an area of the position identified by said position data for comparison with the outputs from said rail and truck angle sensors.

7. A route detector for a railway vehicle traveling a route along a track, said railway vehicle including a vehicle body and a wheel supporting truck pivotally mounted on said vehicle body, said route detector comprising:

at least one truck angle sensor mounted on said railway vehicle to provide a truck angle signal when said wheel supporting truck pivots angularly relative to said vehicle body, and a central processing unit connected to receive the truck angle signals from said truck angle sensor.

8. The route detector of claim 7 wherein said central processing unit includes previously stored truck angle sensor outputs as stored signatures for special trackwork configurations along the route of said railway vehicle, said central processing unit operating to compare the outputs from said truck angle sensor to one or more of said stored signatures.

9. The route detector of claim 8 which includes one or more vehicle position indicating units connected to said central processing unit to provide position data identifying the position of said railway vehicle to said central processing unit, said central processing unit operating in response to said position data to select stored signatures in an area of the position identified by said position data for comparison with the outputs from said truck angle sensors.

10. A method for detecting the passage of a railway vehicle relative to special trackwork configurations as the railway vehicle travels a route along a track having two spaced rails which includes:

moving a first railway vehicle over special trackwork configurations along the route which is equipped with a plurality of rail sensors mounted on the railway vehicle to provide a rail sensing output signal each time a rail sensor crosses a rail at a special trackwork configuration, storing the rail sensing output signals from said first railway vehicle at each special trackwork configuration as a stored signature for each special trackwork configuration, using a plurality of rail sensors mounted on a second railway vehicle subsequently traveling along the same route to provide a real time rail sensing output signal each time a rail sensor crosses a rail at a special trackwork configuration to create a real time signature and comparing each real time signature with one or more stored signatures.

11. The method of claim 10 which includes:

locating a first rail sensor between the rails of the track, locating a second rail sensor spaced outwardly from a second side of the track, and locating a third rail sensor spaced outwardly from a third side of the track opposite to said second side.

12. The method of claim 11 which includes:

locating said first rail sensor centrally between the rails of the track, and equally spacing said second and third rail sensors from said first rail sensor.

13. The method of claim 10 wherein said first and second railway vehicles each include a vehicle body and a wheel supporting truck pivotally mounted on said vehicle body, the method further including:

mounting a truck angle sensor on said first railway vehicle to provide a truck angle signal when said wheel truck pivots relative to said vehicle body as said first railway vehicle moves over a special trackwork configuration, storing said truck angle signals from said first railway vehicle at each special trackwork configuration as part of the stored signature for such special trackwork configuration, using a truck angle sensor mounted on said second railway vehicle to provide a real time truck angle signal each time said wheel truck pivots relative to the body of said second railway vehicle at a special trackwork configuration, and including said real time truck angle signal in said real time signature.

14. The method of claim 13 which includes:

locating a first rail sensor between the rails of the track, locating a second rail sensor spaced outwardly from a second side of the track, and locating a third rail sensor spaced outwardly from a third side of the track opposite to said second side.

15. The method of claim 14 which includes:

locating said first rail sensor centrally between the rails of the track, and equally spacing said second and third rail sensors from said first rail sensor.

16. A method for detecting passage of a railway vehicle relative to special trackwork configurations as the railway vehicle travels a route along a track having two spaced rails which includes:

moving a first railway vehicle having a wheel supporting truck pivoted on a vehicle body over special trackwork configurations along the route which is equipped with a truck angle sensor mounted on the railway vehicle to provide a truck angle output signal each time the wheel supporting truck pivots relative to the vehicle body as the railway vehicle passes over a special trackwork configuration, storing the truck angle output signals from said first railway vehicle at each special trackwork configuration as a stored signature for each special trackwork configuration, using a truck angle sensor mounted on a second railway vehicle subsequently traveling along the same route to provide a real time truck angle output each time the wheel supporting of truck pivots relative to the vehicle body at a special trackwork configuration to create a real time signature, and comparing each real time signature with one or more stored signatures.

* * * * *